US011409230B2

(12) United States Patent
Hashimoto et al.

(10) Patent No.: US 11,409,230 B2
(45) Date of Patent: Aug. 9, 2022

(54) DEVELOPING CARTRIDGE INCLUDING FIRST AND SECOND CAMS CONNECTED BY CONNECTION MEMBER AND MOVABLE RELATIVE TO CASING

(71) Applicant: BROTHER KOGYO KABUSHIKI KAISHA, Nagoya (JP)

(72) Inventors: Junichi Hashimoto, Toyohashi (JP); Yasushi Okabe, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/379,094

(22) Filed: Jul. 19, 2021

(65) Prior Publication Data

US 2021/0341874 A1 Nov. 4, 2021

Related U.S. Application Data

(63) Continuation of application No. PCT/JP2020/005466, filed on Feb. 13, 2020.

(30) Foreign Application Priority Data

Mar. 28, 2019 (JP) ..... JP2019-063305

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1647; G03G 21/1676; G03G 21/1821; G03G 21/1842
See application file for complete search history.

(56) References Cited

U.S. PATENT DOCUMENTS 6,334,034 B1 12/2001 Kitazawa et al.
2010/0166453 A1* 7/2010 Okabe ..... G03G 21/1647 399/111

(Continued)

FOREIGN PATENT DOCUMENTS

JP 60-125865 A 7/1985
JP 5-35078 A 2/1993

(Continued)

OTHER PUBLICATIONS

International Search Report issued in PCT/JP2020/005466 dated Mar. 17, 2020.

*Primary Examiner* — Sophia S Chen
(74) *Attorney, Agent, or Firm* — Merchant & Gould P.C.

(57) ABSTRACT

A developing cartridge includes: a casing; a developing roller rotatable about an axis extending in a first direction; a first cam positioned at one end portion of the casing; a second cam positioned at another end portion of the casing; and a connection member connecting the first cam and the second cam to each other. The first cam is movable relative to the casing and the developing roller in the first direction between a first position and a second position, and the second cam is movable relative to the casing and the developing roller in the first direction between a third position and a fourth position. The second cam is movable from the third position to the fourth position due to a tensile force of the connection member in accordance with movement of the first cam from the first position to the second position.

28 Claims, 15 Drawing Sheets

(56) References Cited

U.S. PATENT DOCUMENTS

| | | | | |
|---|---|---|---|---|
| 2011/0064457 | A1 | 3/2011 | Okabe et al. | |
| 2016/0179051 | A1 | 6/2016 | Kim et al. | |
| 2019/0302682 | A1* | 10/2019 | Wang | G03G 21/1647 |
| 2020/0103817 | A1* | 4/2020 | Wang | G03G 21/1647 |

FOREIGN PATENT DOCUMENTS

| | | | |
|---|---|---|---|
| JP | 8-171324 | A | 7/1996 |
| JP | 2001-22159 | A | 1/2001 |
| JP | 2011-59510 | A | 3/2011 |
| JP | 2013-125149 | A | 6/2013 |
| JP | 2014-170254 | A | 9/2014 |

* cited by examiner

DEVELOPING CARTRIDGE INCLUDING FIRST AND SECOND CAMS CONNECTED BY CONNECTION MEMBER AND MOVABLE RELATIVE TO CASING

CROSS REFERENCE TO RELATED APPLICATION

This is a by-pass continuation application of International Application No. PCT/JP2020/005466 filed Feb. 13, 2020 claiming priority from Japanese Patent Application No. 2019-063305 filed Mar. 28, 2019. The entire contents of the International Application and the priority application are incorporated herein by reference.

TECHNICAL FIELD

The present disclosure relates to a developing cartridge.

BACKGROUND

Conventionally, there has been known an electro-photographic type image forming apparatus such as a laser printer and an LED printer. The image forming apparatus includes a developing cartridge. The developing cartridge includes a developing roller for supplying developing agent. One conventional image forming apparatus is described in a prior art, for example. The image forming apparatus described in the prior art includes a drum cartridge including a photosensitive drum. The developing cartridge is attachable to the drum cartridge. Upon attachment of the developing cartridge to the drum cartridge, the photosensitive drum and the developing roller are brought into contact with each other.

SUMMARY

The image forming apparatus disclosed in the prior art is switchable between a state where the developing roller and the photosensitive drum are in contact with each other and a state where the developing roller and the photosensitive drum are separated from each other. In the image forming apparatus disclosed in the prior art, components for moving the developing cartridge to separate the developing roller from the photosensitive drum are provided at each side of a drum unit. The components at each side need to receive a driving force from a main body of the image forming apparatus.

In view of the foregoing, it is an object of the present disclosure to provide a developing cartridge capable of moving a developing roller away from a photosensitive drum due to a driving force applied to only one side without necessitating application of a driving force to both sides.

In order to attain the above and other objects, according to one aspect, the present disclosure provides a developing cartridge including: a casing; a developing roller; a first cam; a second cam; and a connection member. The casing is configured to accommodate developing agent therein. The casing includes one end portion and another end portion spaced apart from the one end portion in a first direction. The developing roller is rotatable about a developing roller axis extending in the first direction. The first cam is positioned at the one end portion of the casing. The first cam is movable relative to the casing and the developing roller in the first direction between a first position and a second position. The first cam in the second position is positioned closer to the another end portion of the casing in the first direction than the first cam in the first position is to the another end portion of the casing. The second cam is positioned at the another end portion of the casing. The second cam is movable relative to the casing and the developing roller in the first direction between a third position and a fourth position. The second cam in the fourth position is positioned closer to the another end portion of the casing in the first direction than the second cam in the third position is to the another end portion of the casing. The connection member connects the first cam and the second cam to each other. The second cam is movable from the third position to the fourth position due to a tensile force of the connection member in accordance with movement of the first cam from the first position to the second position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the present disclosure will be described while referring to the accompanying drawings.

In the following description, a direction in which a rotational axis of a developing roller (a developing roller-axis) will be referred to as "first direction". Here, an outer circumferential surface of the developing roller includes a portion exposed to an outside of a casing, and another portion positioned inside the casing. A direction in which the portion of the circumferential surface of the developing roller and the other portion of the circumferential surface of the developing roller are arrayed will be referred to as "second direction". The first direction and the second direction cross each other. Preferably, the first direction and the second direction are perpendicular to each other. Further, a direction crossing both the first direction and the second direction will be referred to as "third direction". Preferably, the third direction is perpendicular to both the first direction and the second direction.

<1. Overall Configuration of Image Forming Apparatus>

Figure 1:
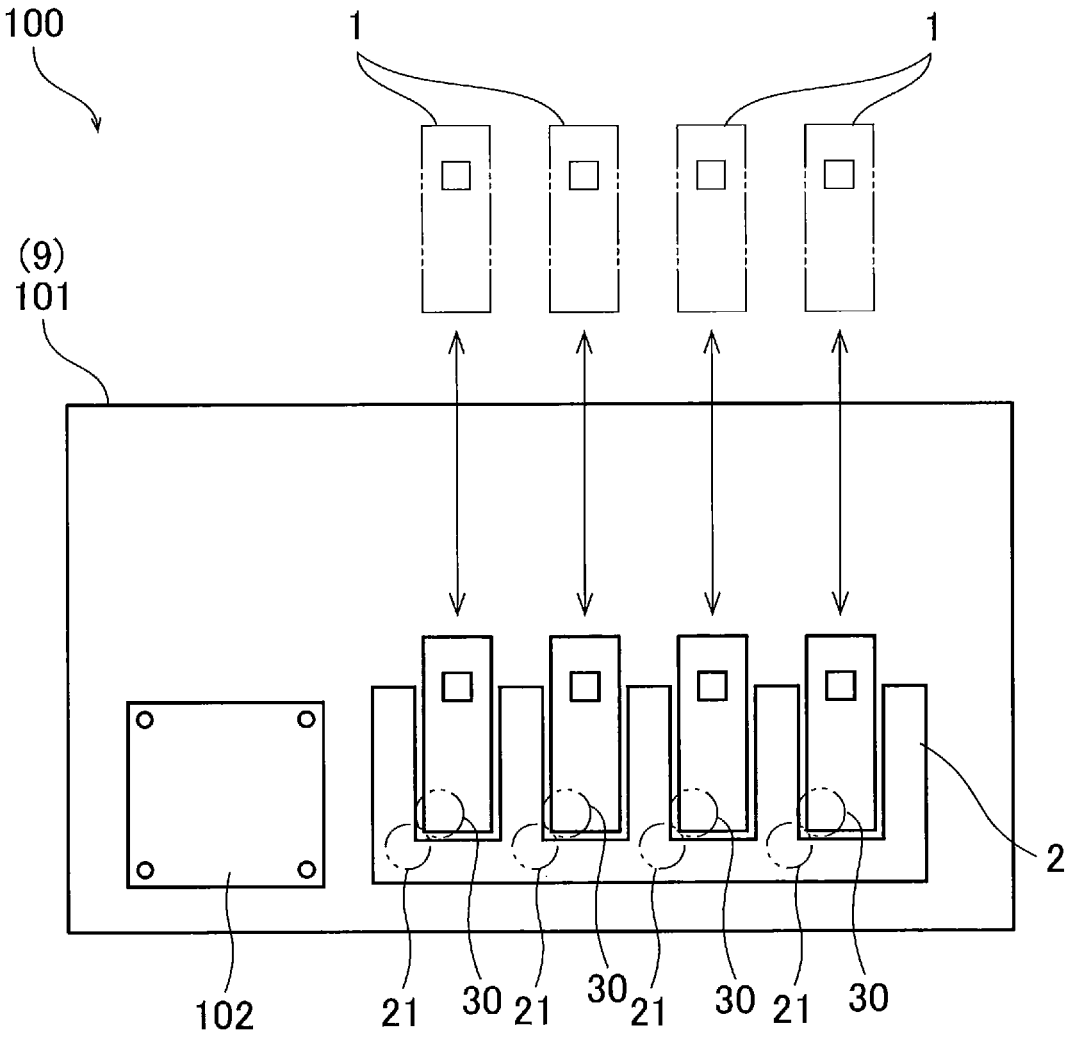
FIG. 1 is a schematic diagram of an image forming apparatus including a developing cartridge according to one embodiment of the present disclosure.

FIG. 1 is a schematic diagram of an image forming apparatus 100. The image forming apparatus 100 is an electro-photographic type printer such as a laser printer and an LED printer. As illustrated in FIG. 1, the image forming apparatus 100 includes four developing cartridges 1, a drum cartridge 2, and a main body portion 9.

<1-1. Overall Configuration of Main Body Portion>

Hereinafter, an overall configuration of the main body portion 9 will be described. The main body portion 9 includes a main frame 101, a transfer belt (not illustrated), and a controller 102.

The main frame 101 has a generally rectangular-parallelepiped shape, and has an internal space. The drum cartridge 2 to which the developing cartridges 1 are attached can be accommodated in the internal space of the main frame 101. Further, four chargers (not illustrated), four light sources (not illustrated), the transfer belt, and the controller 102 are provided in the main frame 101.

The transfer belt is an endless belt for conveying printing sheets. The transfer belt is positioned opposite to developing rollers 30 with respect to photosensitive drums 21 of the drum cartridge 2 in a state where the drum cartridge 2 to which the developing cartridges 1 are attached is positioned in the internal space of the main frame 101. The transfer belt has an outer peripheral surface capable of contacting outer circumferential surfaces of the photosensitive drums 21.

The controller 102 includes a processor such as CPU, and a main body memory. The main body memory is a storage medium from which information is readable and to which information is writable. For example, the main body memory is a flash ROM or an EEPROM. The memory stores therein computer programs for controlling operations performed in the image forming apparatus 100. The processor is configured to execute various processing in accordance with the computer programs stored in the memory. That is, the processor is configured to execute various printing process and other processes associated therewith to be performed in the image forming apparatus 100.

<1-2. Overall Configuration of Drum Cartridge>

Figure 2:
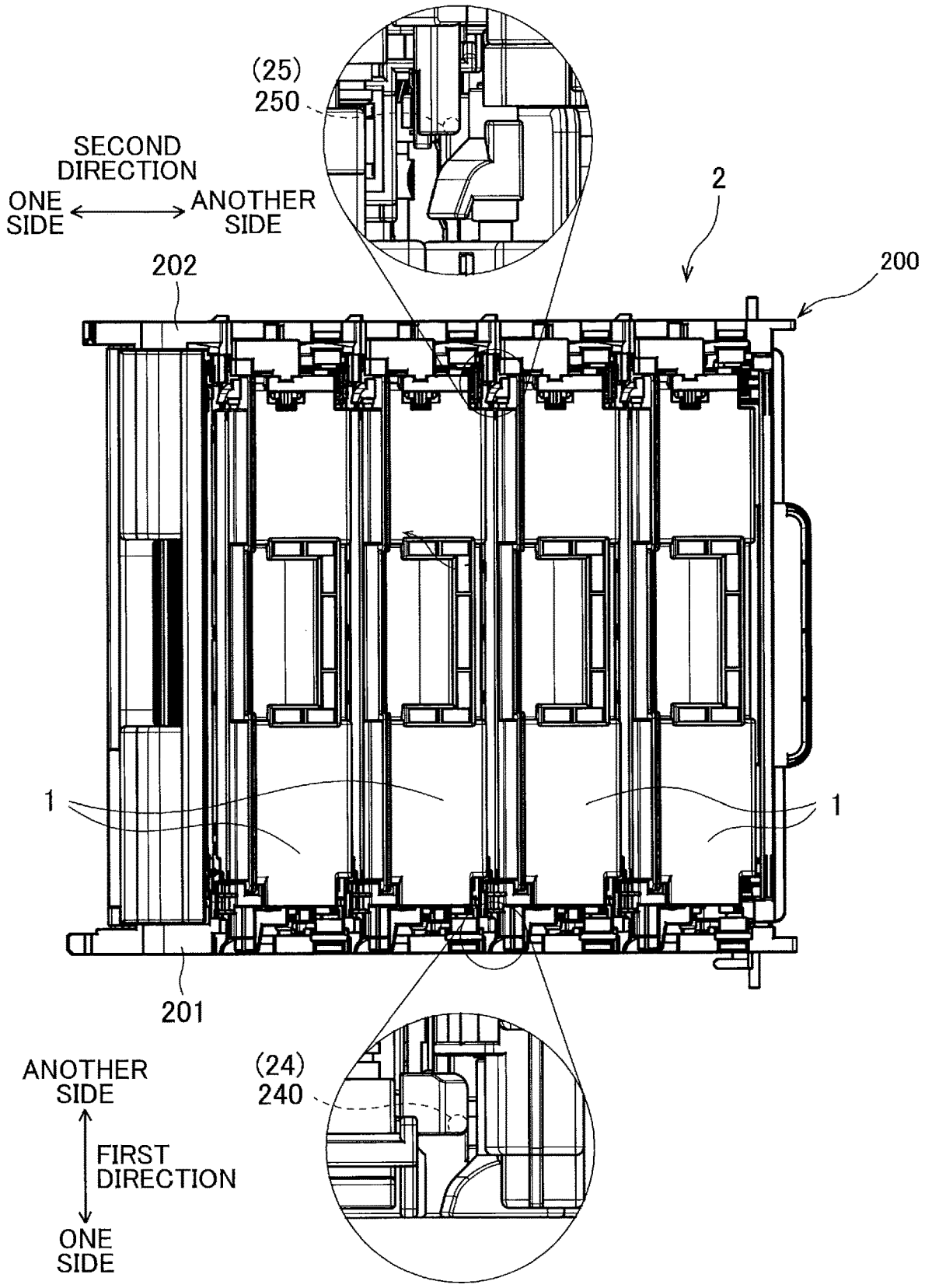
FIG. 2 is a view of a drum cartridge to which the developing cartridge according to the embodiment is attached as viewed in a third direction from another side toward the one side.

Next, an overall configuration of the drum cartridge 2 will be described. FIG. 2 is a view of the drum cartridge 2 to which the developing cartridges 1 are attached as viewed in the third direction from another side toward one side. As illustrated in FIGS. 1 and 2, the drum cartridge 2 includes the four photosensitive drums 21, and a frame 200.

Each of the four photosensitive drums 21 illustrated in FIG. 1 has an outer circumferential surface having a cylindrical shape centered on a drum axis, which is a rotational axis extending in the first direction. The outer circumferential surface of each photosensitive drum 21 is coated with photosensitive material. Each of the photosensitive drums 21 is rotatable about its drum axis.

The frame 200 is a frame that supports the four photosensitive drums 21 such that the four photosensitive drums 21 are arranged to be spaced from one another in the second direction. The frame 200 includes a pair of side frames 201 and 202 facing each other in the first direction. The photosensitive drums 21 are rotatably supported by the side frames 201 and 202.

<1-3. Overall Configurations of Developing Cartridges>

Figure 5:
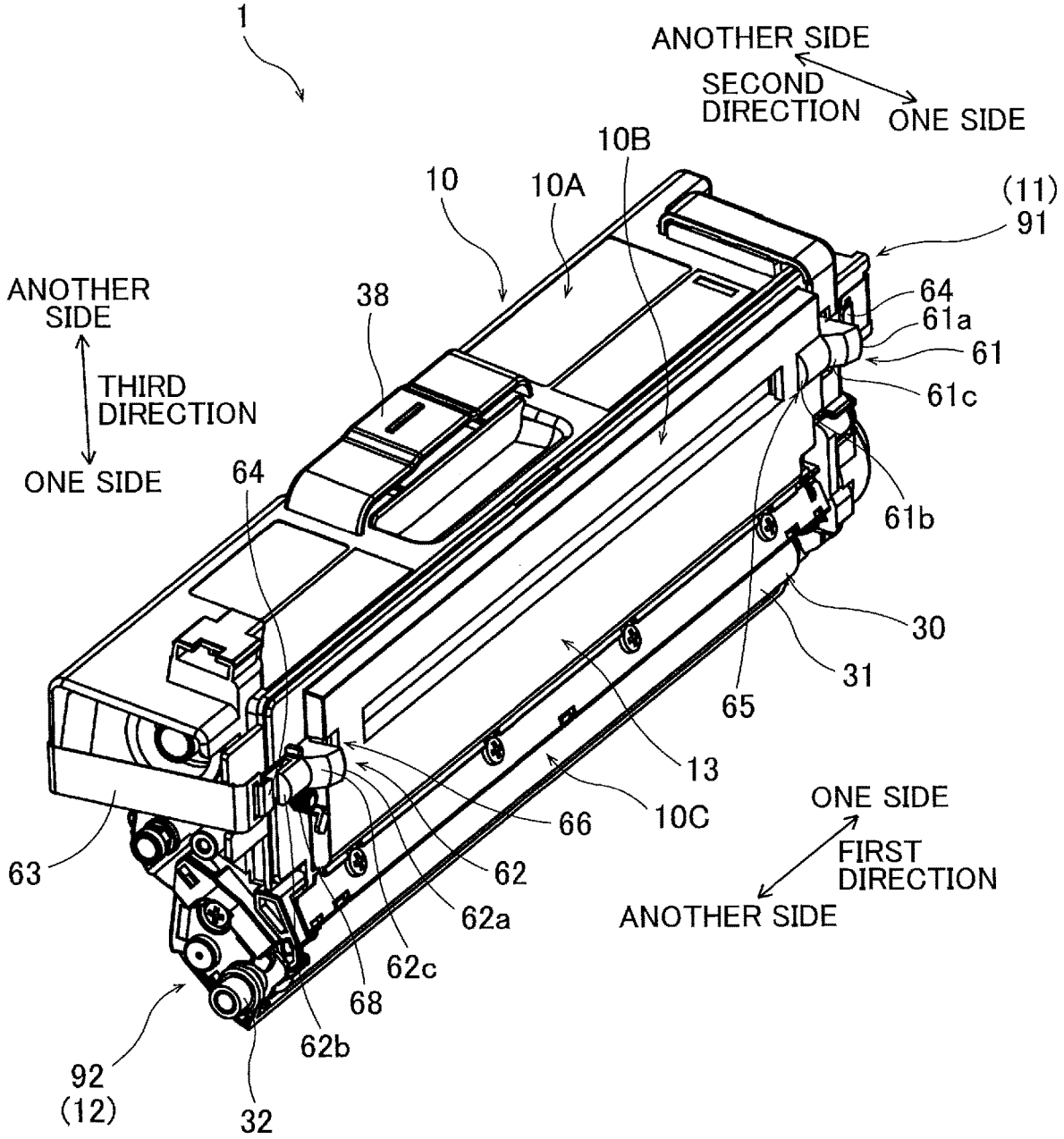
FIG. 5 is a perspective view of the developing cartridge according to the embodiment.
Figure 6:
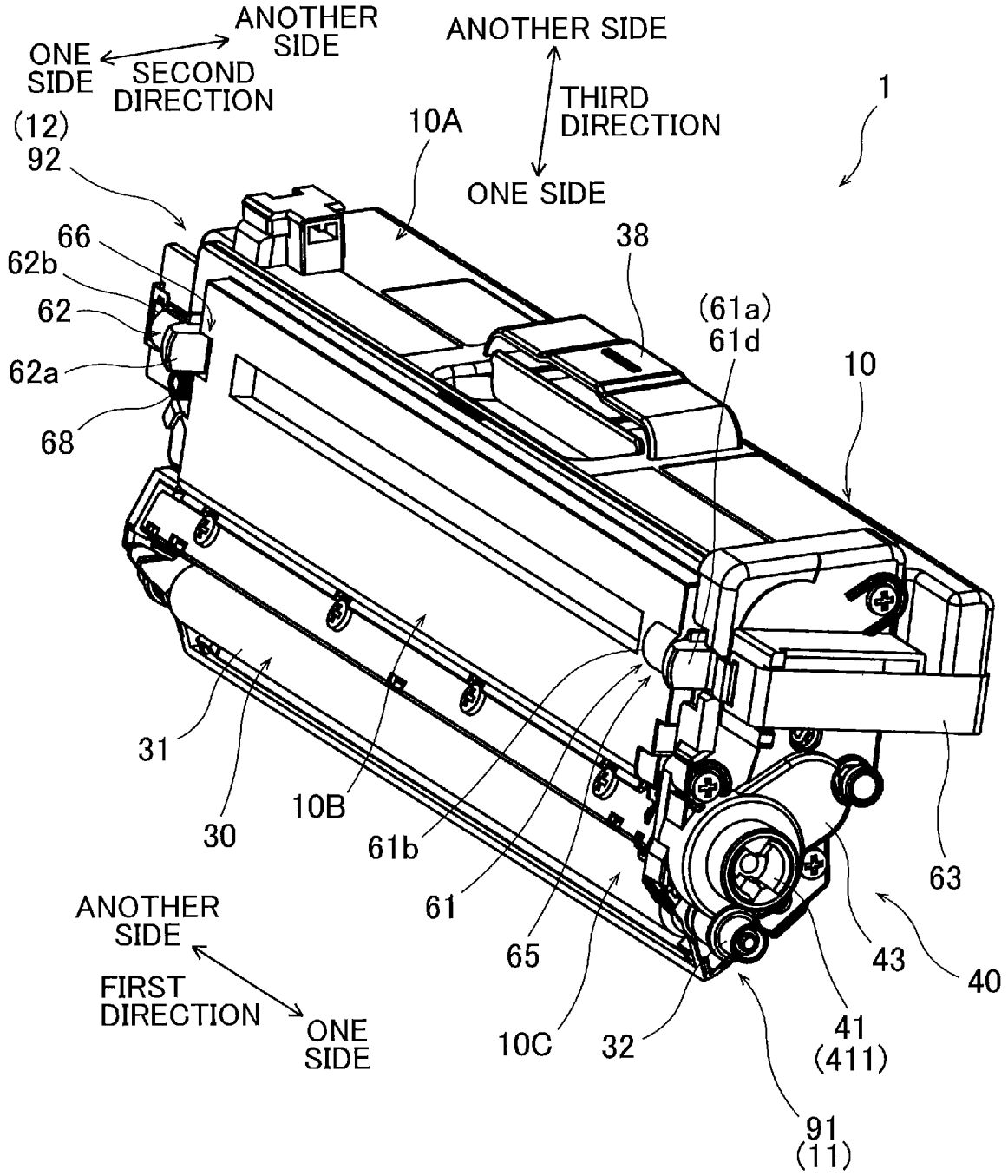
FIG. 6 is another perspective view of the developing cartridge according to the embodiment.
Figure 7:
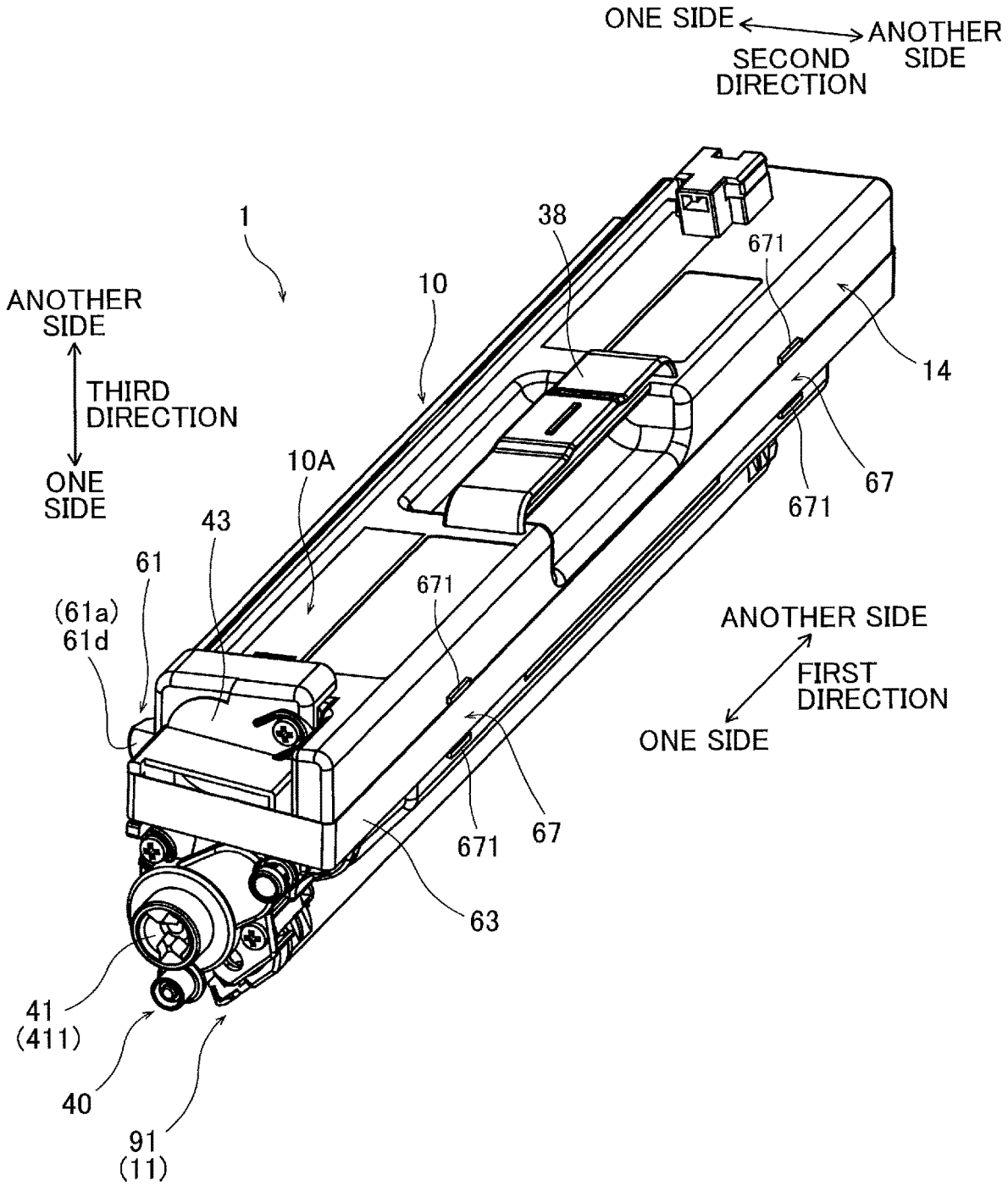
FIG. 7 is still another perspective view of the developing cartridge according to the embodiment.

Hereinafter, overall configurations of the developing cartridges 1 will be described. FIGS. 5 to 7 are perspective views of the developing cartridge 1.

As illustrated in FIGS. 1 and 2, the developing cartridges 1 are attachable to and detachable from the frame 200 of the drum cartridge 2. As illustrated in FIG. 5, each of the developing cartridges 1 includes a casing 10 configured to accommodate developing agent therein. The casing 10 includes a container 10A and a lid 10B (an example of a frame). The container 10A has an internal space. The lid 10B has a flat plate shape. The lid 10B is positioned at one end portion in the second direction of the casing 10 to cover an opening formed at one end portion in the second direction of the container 10A. Further, the lid 10B has a third outer surface 13 (described later). In the meantime, the container 10A further has an opening portion 10C at one end portion in the third direction thereof. The developing roller 30 (described later) is positioned in the opening portion 10C.

The casing 10 has one end portion 91, and another end portion 92 spaced apart from the one end portion 91 in the first direction. A first outer surface 11 is positioned at the one end portion 91 of the casing 10, and a second outer surface 12 is positioned at the other end portion 92 of the casing 10. That is, the first outer surface 11 is positioned at one end portion in the first direction of the casing 10, while the second outer surface 12 is positioned at another end portion in the first direction of the casing 10. The casing 10 further has the third outer surface 13 and a fourth outer surface 14 (see FIG. 7) spaced apart from each other in the second direction. The third outer surface 13 is positioned at one end portion in the second direction of the casing 10. The fourth outer surface 14 is positioned at another end portion in the second direction of the casing 10.

The four developing cartridges 1 accommodate therein toners of colors different from one another (for example, cyan, magenta, yellow and black). However, the developing cartridges 1 may accommodate therein toner of the same color.

Each of the developing cartridges 1 includes the developing roller 30 having a cylindrical shape. The developing roller 30 is rotatable about a developing roller-axis which is a rotational axis extending in the first direction. The developing roller 30 is supported by the casing 10 so as to be rotatable about the developing roller-axis.

The developing roller 30 includes a developing roller body 31 and a developing roller shaft 32. The developing roller body 31 has a hollow cylindrical shape and extends in the first direction. The developing roller body 31 is made of material having elasticity such as rubber. The developing roller shaft 32 is a solid cylindrical member that penetrates the developing roller body 31 in the first direction. The developing roller shaft 32 is made of metal or electrically conductive resin.

The developing roller body 31 is fixed to the developing roller shaft 32 so that relative rotation of the developing roller body 31 with respect to the developing roller shaft 32 is prevented. That is, the developing roller body 31 is rotatable together with the developing roller shaft 32 about the developing roller-axis. An outer circumferential surface of the developing roller body 31 having one end portion in the second direction exposed to an outside of the casing 10 through the opening portion 10C. Another end portion in the second direction of the outer circumferential surface of the developing roller body 31 is positioned inside the casing 10.

A developing roller gear (not illustrated) is coupled to one end portion in the first direction of the developing roller shaft 32. The developing roller gear is positioned at the first outer surface 11. The developing roller gear is fixed to the developing roller shaft 32 so that relative rotation between the developing roller gear and the developing roller shaft 32 is prevented. Hence, rotation of the developing roller gear causes rotation of the developing roller shaft 32 to rotate the developing roller body 31 together with the developing roller shaft 32.

Incidentally, the developing roller shaft 32 may not penetrate the developing roller body 31 in the first direction. For example, two developing roller shafts 32 may extend in the first direction from both ends in the first direction of the developing roller body 31, respectively.

As illustrated in FIGS. 6 and 7, the developing cartridge 1 includes a gear portion 40. The gear portion 40 is positioned at the first outer surface 11 of the casing 10. The gear portion 40 includes the developing roller gear described above, a coupling 41, and a gear cover 43.

The coupling 41 is a rotary member configured to receive a driving force supplied from a power source of the image forming apparatus 100. The coupling 41 is rotatable about a rotational axis extending in the first direction. The coupling 41 has a fixing hole 411 recessed in the first direction. Upon attachment of the drum cartridge 2 to which the developing cartridges 1 are attached to the main body portion 9 of the image forming apparatus 100, a transmission shaft (not illustrated) of the main body portion 9 is inserted into the fixing hole 411. As a result, the transmission shaft and the coupling 41 are coupled to each other so as not to rotate relative to each other. Accordingly, rotation of the transmission shaft causes rotation of the coupling 41, which causes rotation of the developing roller gear along with the rotation of the developing roller 30. Further, rotation of the coupling 41 also causes rotations of a supply roller (not illustrated) and an agitator (not illustrated).

The casing 10 has an outer surface positioned at another end portion in the third direction of the casing 10. A handle 38 is positioned at the outer surface to be gripped by a user.

When performing a printing process in the image forming apparatus 100, the controller 102 drives a motor (not illustrated). As the motor is driven, the photosensitive drum 21 and the developing roller 30 receive a driving force from the motor through the transmission shaft and the coupling 41 to rotate. Further, the controller 102 supplies electric power to each charger (not illustrated) to charge the outer circumferential surface of the corresponding photosensitive drum 21. Further, the controller 102 turns on each light source (not illustrated) so that the light source emits light onto the outer circumferential surface of the corresponding photosensitive drum 21. Accordingly, an electrostatic latent image corresponding to an image to be printed is formed on the outer circumferential surface of the photosensitive drum 21.

The toner accommodated in the developing cartridge 1 is supplied through the developing roller 30 to the electrostatic latent image formed on the photosensitive drum 21. As a result, the electrostatic latent image becomes a visible toner image on the outer circumferential surface of the photosensitive drum 21. In the meantime, a printing sheet is conveyed to a portion between the photosensitive drum 21 and the transfer belt. Hence, the toner image is transferred from the outer circumferential surface of the photosensitive drum 21 to the printing sheet. The printing sheet carrying the toner image thereon is then conveyed to a fixing unit (not illustrated) provided in the image forming apparatus 100 where the toner image is thermally fixed to the printing sheet. As a result, an image is printed on the printing sheet.

In the image forming apparatus 100, it is preferable that each of the developing rollers 30 be separated from the corresponding one of the photosensitive drums 21 in order to change colors for printing or during a standby period. To this end, the image forming apparatus 100 according to the present embodiment provides a contacting state and separated state. In the contacting state of the image forming apparatus 100, the developing rollers 30 and the corresponding photosensitive drums 21 are in contact with each other in a state where the developing cartridges 1 are attached to the drum cartridge 2. In the separated state of the image forming apparatus 100, the developing rollers 30 and the corresponding photosensitive drums 21 are separated from each other in the state where the developing cartridges 1 are attached the drum cartridge 2.

To this effect, as components for realizing the contact and the separation between the developing rollers 30 and the corresponding photosensitive drums 21, each of the developing cartridges 1 further includes a first cam 61, a second cam 62, a connection member 63, two hooks 64, a first guide groove 65, a second guide groove 66, two positioning grooves 67, and an elastic member 68. Also, as components for realizing the contact and the separation, the drum cartridge 2 further includes first cylinders 24 and second cylinders 25. Still also, as components for realizing the contact and the separation, the main body portion 9 includes drive shafts 103.

<2. Components in Drum Cartridge for Performing Contact and Separation>

Figure 3:
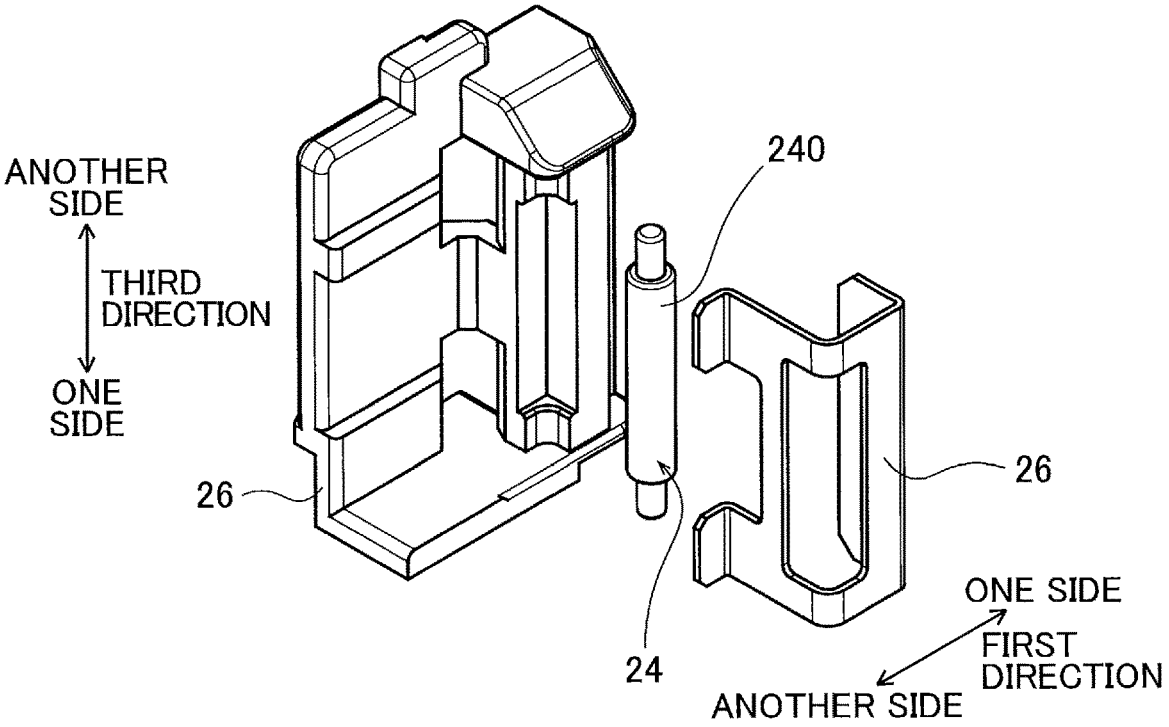
FIG. 3 is a perspective view of a first cylinder and a bearing that supports the first cylinder of the drum cartridge.
Figure 4:
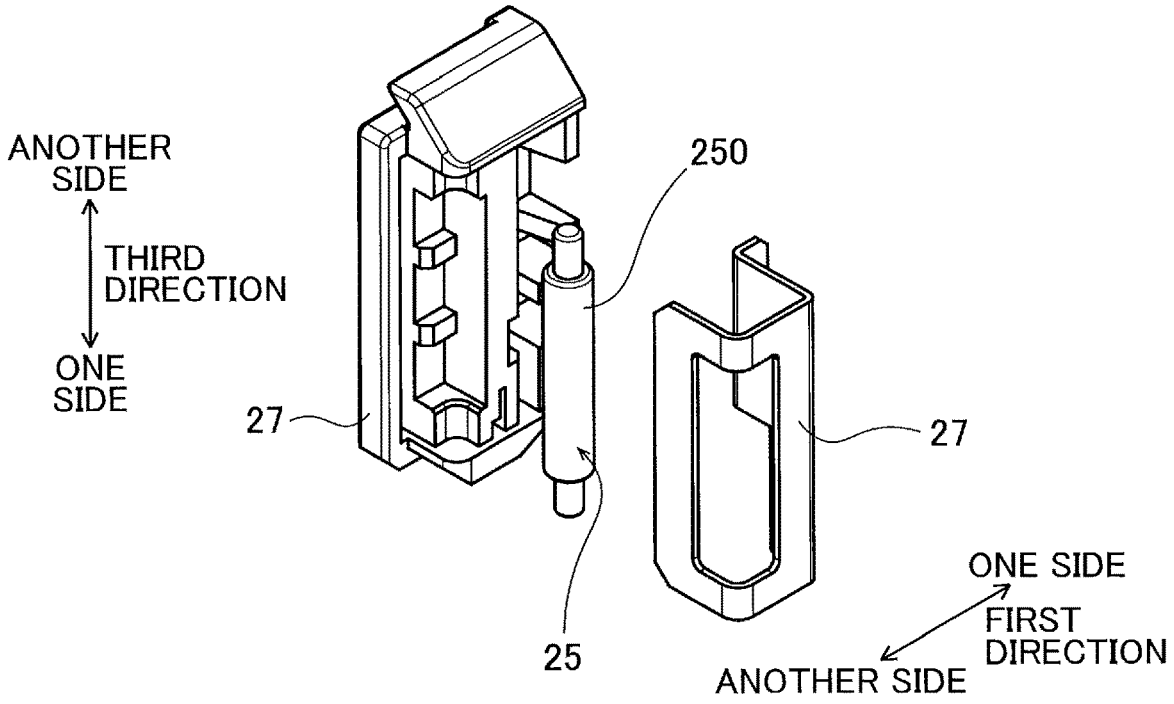
FIG. 4 is a perspective view of a second cylinder and a bearing that supports the second cylinder of the drum cartridge.

Hereinafter, components of the drum cartridge 2 for performing the contact and the separation between the developing rollers 30 and the corresponding photosensitive drums 21 will be described with reference to FIGS. 2 to 4. FIG. 3 is a perspective view of the first cylinder 24. FIG. 4 is a perspective view of the second cylinder 25.

As illustrated in FIG. 2, in a state where the developing cartridges 1 are attached to the drum cartridge 2, the first outer surfaces 11 of the developing cartridges 1 face an inner surface of the side frame 201 in the first direction. Similarly, in a state where the developing cartridges 1 are attached to the drum cartridge 2, the second outer surfaces 12 of the developing cartridges 1 face an inner surface of the side frame 202 in the first direction.

As indicated by a broken line in a partial enlarged view in FIG. 2, the side frame 201 includes the first cylinders 24.

That is, the first cylinders 24 are positioned at one end portion in the first direction of the frame 200.

FIG. 3 is an exploded perspective view of the first cylinder 24 and a bearing 26 that holds the first cylinder 24. As illustrated in FIG. 3, the first cylinder 24 is cylindrical in shape centered on a first rotational axis extending in the third direction. The first cylinder 24 has an outer circumferential surface serving as a first contact surface 240 that is capable of contacting a first inclined surface 61*c* of the first cam 61 (described later). The first cylinder 24 has one end portion and another end portion in the third direction each rotatably supported by the bearing 26. With this configuration, the first cylinder 24 is rotatable about the first rotational axis extending in the third direction.

As indicated by a broken line in another partial enlarged view in FIG. 2, the side frame 202 includes the second cylinders 25. That is, the second cylinders 25 are positioned at another end portion in the first direction of the frame 200.

FIG. 4 is an exploded perspective view of the second cylinder 25 and a bearing 27 that holds the second cylinder 25. As illustrated in FIG. 4, the second cylinder 25 is cylindrical in shape centered on a second rotational axis extending in the third direction. The second cylinder 25 has an outer circumferential surface functioning as a second contact surface 250 capable of contacting a second inclined surface 62*c* of the second cam 62 (described later). The second cylinder 25 has one end portion and another end portion in the third direction each rotatably supported by the bearing 27. Thus, the second cylinder 25 is rotatable about the second rotational axis extending in the third direction.

Each of the first cylinders 24 and corresponding each of the second cylinder 25 are aligned with each other in the first direction as a pair. As will be described later, components in the developing cartridge 1 for performing the contact and the separation between the developing rollers 30 and the corresponding photosensitive drums 21 are capable of contacting the first contact surface 240 of the first cylinder 24 and the second contact surface 250 of the second cylinder 25.

<3. Components in Main Body Portion for Performing Contact and Separation>

Hereinafter, components of the main body portion 9 for performing the contact and the separation between the developing rollers 30 and the corresponding photosensitive drums 21 will be described. The main body portion 9 includes the drive shafts 103 as illustrated in FIGS. 12, 13, 15 and 16. Each of the drive shafts 103 has one of a solid cylindrical shape and solid prismatic columnar shape extending in the first direction. Each of the drive shafts 103 is movable in the first direction between an advanced position and a retracted position upon receiving a driving force from a power source of the main body portion 9.

<4. Components in Developing Cartridges for Performing Contact and Separation>

Figure 8:
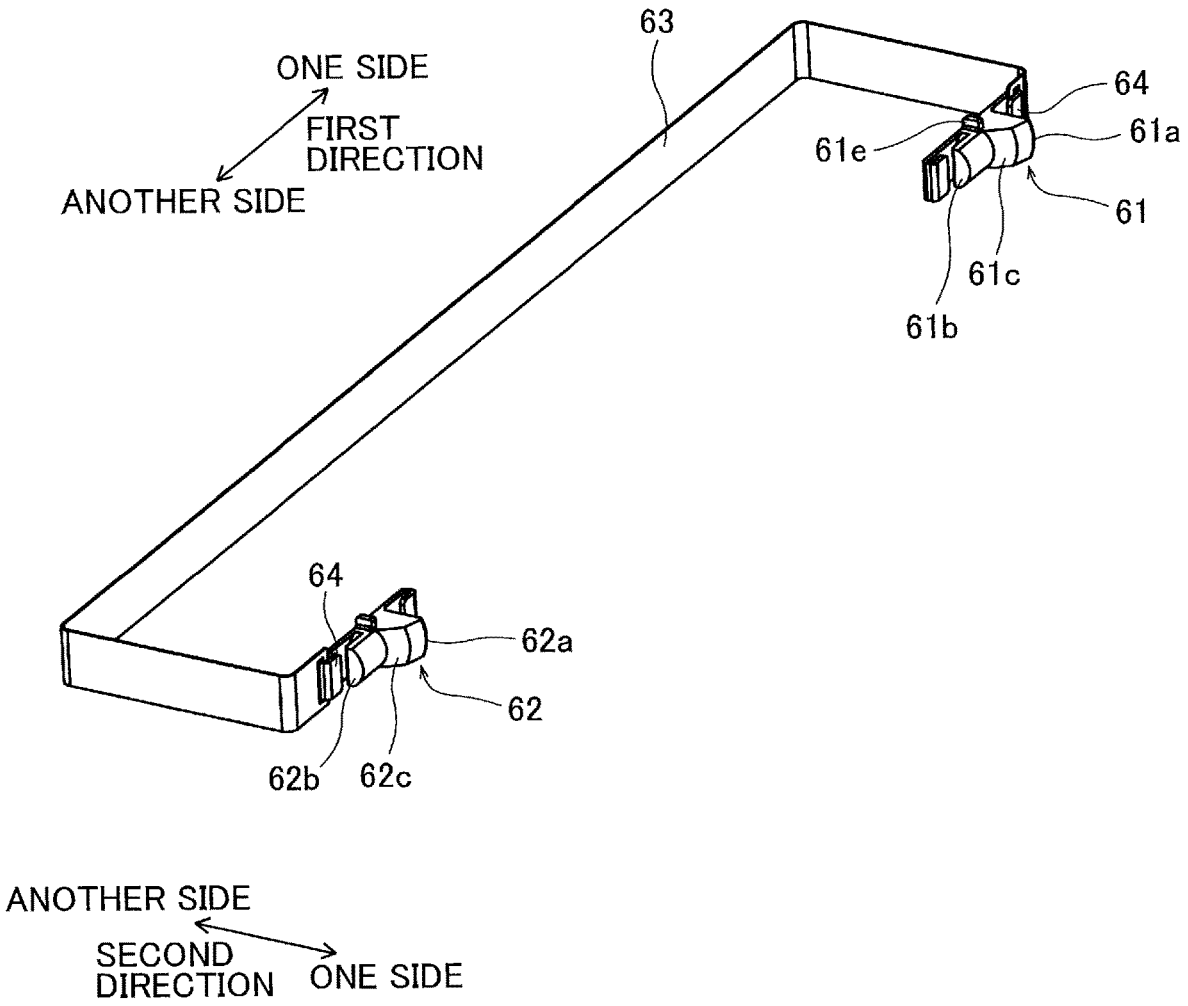
FIG. 8 is a perspective view of a first cam, a second cam, and a connection member in the developing cartridge according to the embodiment.
Figure 9:
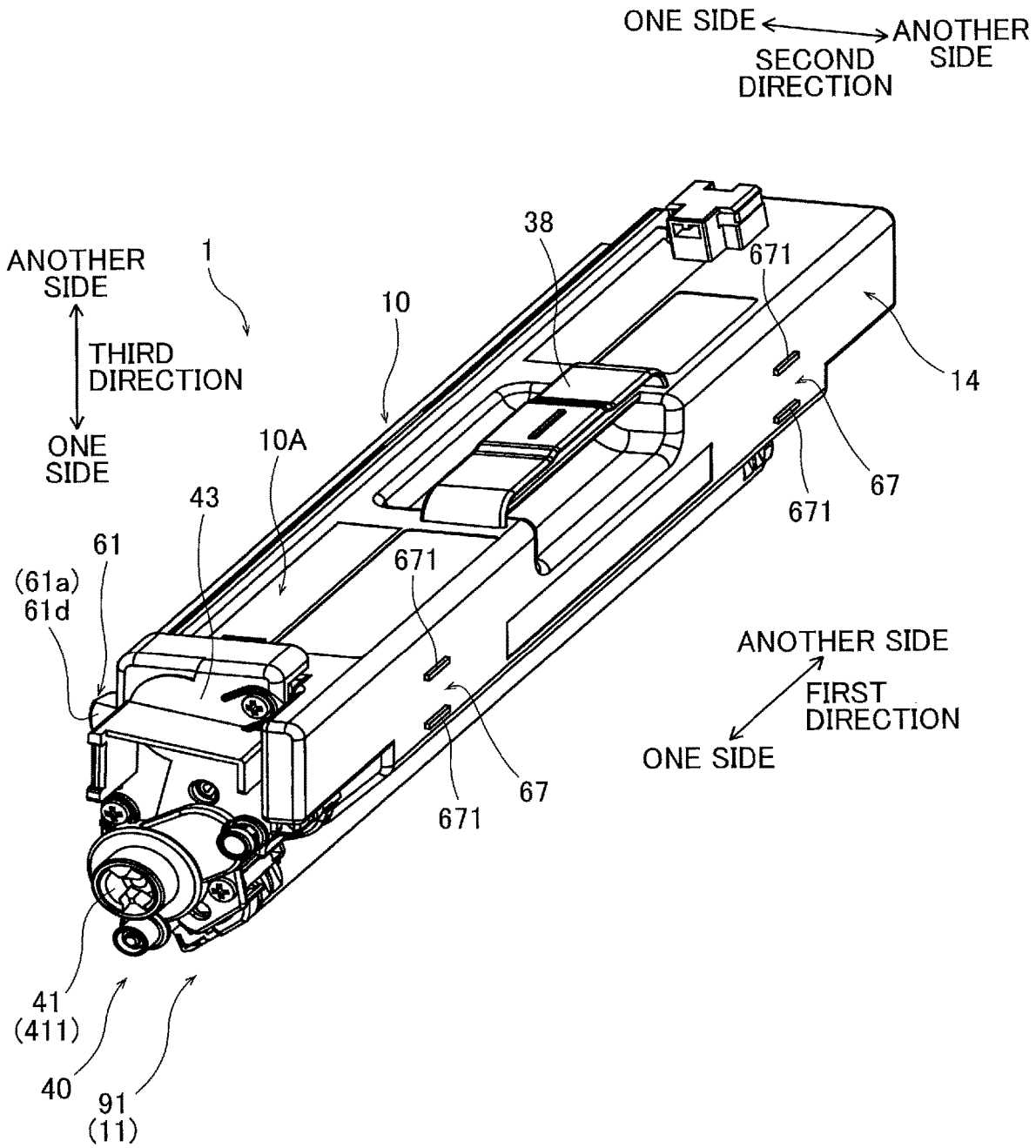
FIG. 9 is a perspective view of the developing cartridge according to the embodiment in which the connection member has been removed.
Figure 10:
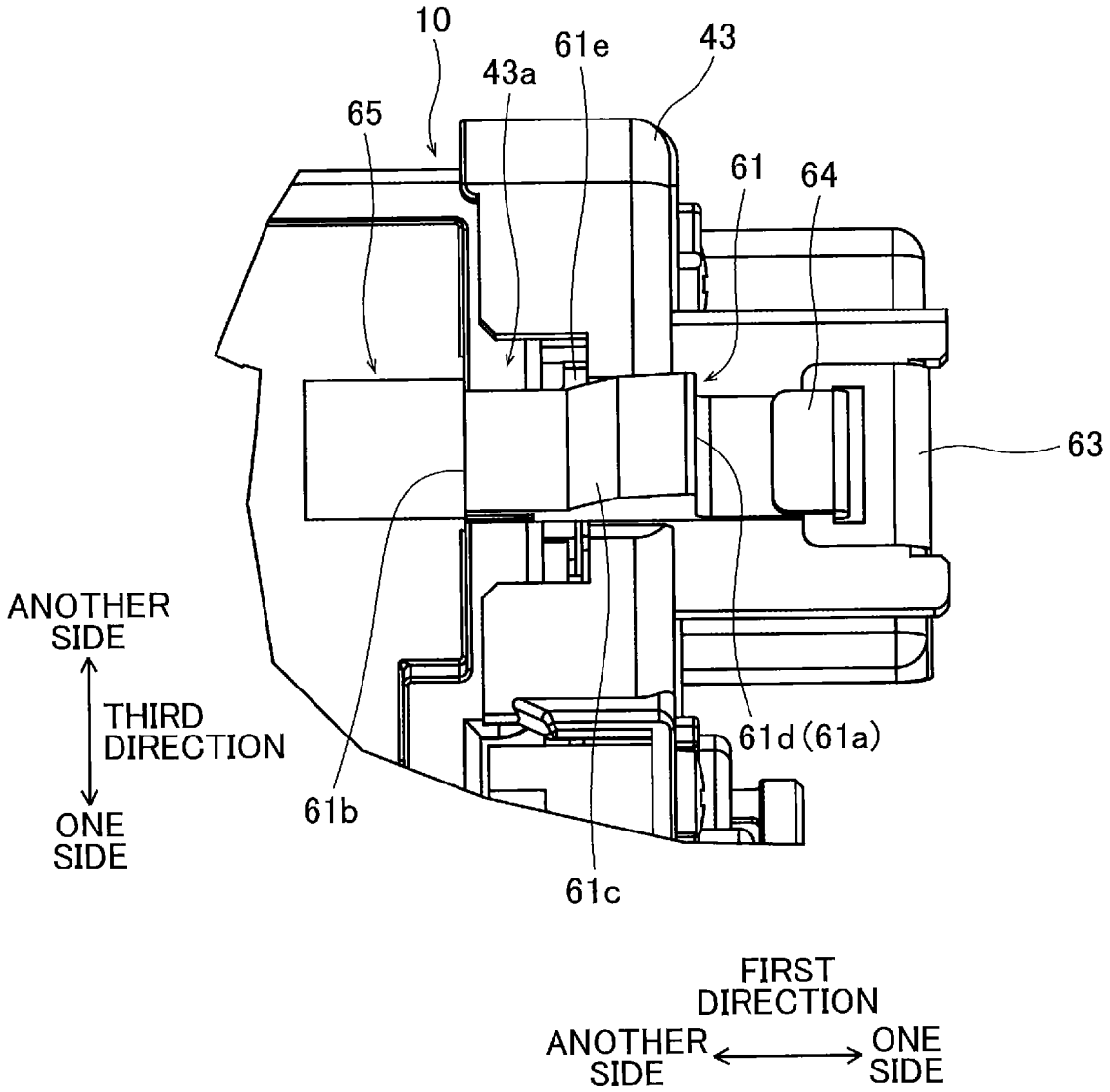
FIG. 10 is a view illustrating a portion in the vicinity of a retainer of the first cam in the developing cartridge according to the embodiment.

Next, components of the developing cartridges 1 for realizing the contact and the separation between the developing rollers 30 and the corresponding photosensitive drums 21 will be described with reference to FIGS. 5 through 10. FIG. 8 is a perspective view of the first cam 61, the second cam 62, and the connection member 63. FIG. 9 is a perspective view of the developing cartridge 1 in which the connection member 63 has been removed. FIG. 10 is a view particularly illustrating a portion in the vicinity of a retainer 61*e* of the first cam 61.

As illustrated in FIGS. 5 through 7, the first cam 61 is positioned at the one end portion 91 of the casing 10 and positioned at the third outer surface 13 of the casing 10. The first cam 61 includes a first end 61*a*, and a second end 61*b* positioned closer to the other end portion 92 of the casing 10 in the first direction than the first end 61*a* is to the other end portion 92.

The first cam 61 further has the first inclined surface 61*c* inclined so as to be distant from the casing 10 as extending from the second end 61*b* toward the first end 61*a*. In other words, the first inclined surface 61*c* approaches the casing 10 in the second direction as extending in the first direction from one side toward another side of the casing 10. In the state where each developing cartridge 1 is attached to the drum cartridge 2, the first cam 61 is movable relative to the photosensitive drum 21 in the second direction together with the casing 10 and the developing roller 30. Further, as will be described later in detail, the first cam 61 is movable in the first direction relative to the casing 10 and the developing roller 30 between a first position and a second position. The first cam 61 in the second position is positioned closer to the other end portion 92 than the first cam 61 in the first position is to the other end portion 92.

The first guide groove 65 is positioned at the third outer surface 13 of the casing 10. Specifically, the lid 10B has the first guide groove 65 at one end portion in the first direction thereof. The first guide groove 65 extends in the first direction and is recessed from an outer surface of the lid 10B toward another end portion in the second direction of the lid 10B. With this configuration, the first guide groove 65 can guide movement of the first cam 61 between the first position and the second position.

As illustrated in FIGS. 6 and 7, the first end 61*a* has a pressure contact surface 61*d*. The pressure contact surface 61*d* is a surface that extends perpendicularly to the first direction.

As illustrated in FIGS. 5 and 6, the second cam 62 is positioned at the other end portion 92 of the casing 10 and positioned at the third outer surface 13 of the casing 10. The second cam 62 includes a third end 62*a*, and a fourth end 62*b* positioned closer to the other end portion 92 of the casing 10 in the first direction than the third end 62*a* is to the other end portion 92.

The second cam 62 has the second inclined surface 62*c* inclined so as to be distant from the casing 10 as extending from the fourth end 62*b* toward the third end 62*a*. In other words, the second inclined surface 62*c* approaches the casing 10 in the second direction as extending in the first direction from the one side toward the other side of the casing 10. In the state where the developing cartridge 1 is attached to the drum cartridge 2, the second cam 62 is movable relative to the photosensitive drum 21 in the second direction together the casing 10 and the developing roller 30. In addition, the second cam 62 is movable in the first direction relative to the casing 10 and the developing roller 30 between a third position and a fourth position. The second cam 62 in the fourth position is positioned closer to the other end portion 92 than the second cam 62 in the third position is to the other end portion 92.

The second guide groove 66 is positioned at the third outer surface 13 of the casing 10. Specifically, the lid 10B has the second guide groove 66 at another end portion in the first direction thereof. The second guide groove 66 extends in the first direction and is recessed from the outer surface of the lid 10B toward the other end portion in the second direction of the lid 10B. Hence, the second guide groove 66 can guide movement of the second cam 62 between the third position and the fourth position.

In the present embodiment, the connection member 63 is a sheet-like member formed of material having flexibility such as polyethylene terephthalate resin. In the following description, a region between one end and another end of the connection member 63 will occasionally be referred to as "intermediate portion of the connection member 63".

The connection member 63 connects the first cam 61 and the second cam 62 to each other. Specifically, the connection member 63 connects the first end 61*a* of the first cam 61 and the fourth end 62*b* of the second cam 62 to each other through the hooks 64. More specifically, one end of the connection member 63 is connected to the first end 61*a* of the first cam 61 through one of the hooks 64, and another end of the connection member 63 is connected to the fourth end 62*b* of the second cam 62 through the remaining one of the hooks 64.

The connection member 63 has a portion extending in the first direction and is positioned at the fourth outer surface 14 of the casing 10. In other words, the portion of the connection member 63 extends in the first direction along the fourth outer surface 14. With this arrangement, a sufficient distance from the one end to the other end of the connection member 63 can be obtained. Further, the connection member 63 can have at least two bending portions. In other words, the intermediate portion of the connection member 63 has a portion extending in the first direction, and another portion extending in a direction crossing the first direction.

As illustrated in FIGS. 7 and 9, the two positioning grooves 67 are positioned at the fourth outer surface 14 of the casing 10 with an interval therebetween in the first direction. In the present embodiment, each of the positioning grooves 67 includes a pair of groove walls 671 extending in the first direction and protruding from the fourth outer surface 14 in the second direction. At least a portion of the connection member 63 is positioned within the positioning grooves 67 (i.e., between the pair of groove walls 671 of each positioning groove 67). This configuration can prevent the intermediate position of the connection member 63 from deviating in position in the third direction on the fourth outer surface 14. The two positioning grooves 67 are an example of a groove.

Figure 11:
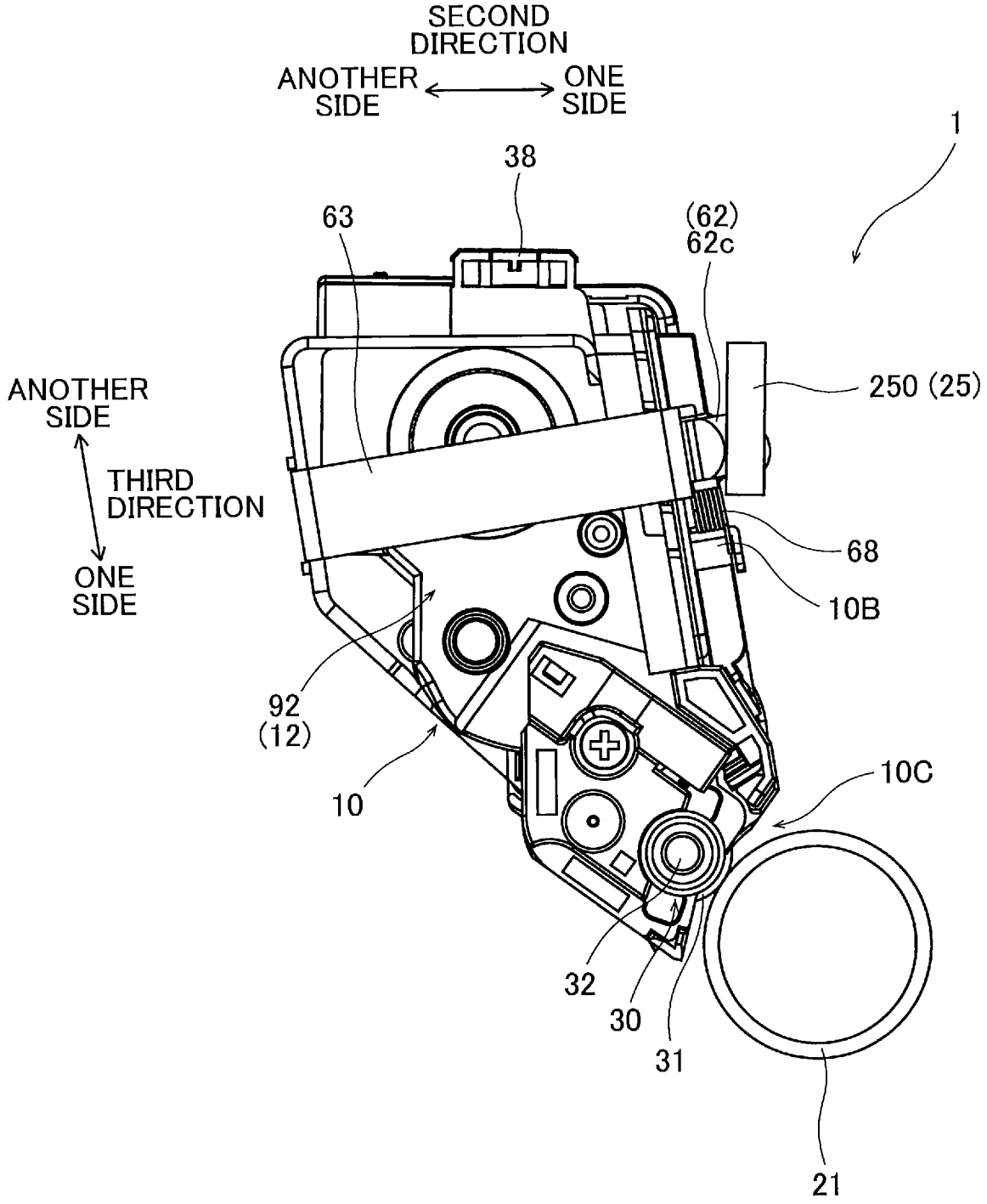
FIG. 11 is a view illustrating the developing cartridge according to the embodiment and a photosensitive drum in the drum cartridge in a contacting state of the image forming apparatus as viewed in a first direction from another side toward one side.

As illustrated in FIGS. 5, 6 and 11, the elastic member 68 is a tension coil spring in the present embodiment. The elastic member 68 is positioned at the other end portion 92 of the casing 10 and positioned at the third outer surface 13. The elastic member 68 has one end connected to the second cam 62, and another end connected to the third outer surface 13 of the casing 10. The elastic member 68 urges the second cam 62 in a direction from the fourth position toward the third position.

As illustrated in FIG. 10, the first cam 61 includes the retainer 61*e* for preventing the first cam 61 from disengaging from the first guide groove 65. The retainer 61*e* protrudes from a body of the first cam 61 in the third direction from one side toward another side. The gear cover 43 has a notch 43*a* on a wall surface (side surface) at one end portion thereof in the second direction. The notch 43*a* is open toward the other side in the first direction of the casing 10. As illustrated in FIG. 10, the retainer 61*e* of the first cam 61 is capable of contacting an inner edge of the notch 43*a*. By this contact, further movement of the first cam 61 in the first direction from the other side toward the one side can be restrained. In other words, disengagement of the first cam 61 from the first guide groove 65 can be avoided by the contact between the retainer 61*e* and the inner edge of the notch 43*a*.

<5. Movement of Each Component at the Time of Switching Between Contacting State and Separated State>

Hereinafter, how each component operates for realizing switching between the contact and the separation will be described with reference to FIGS. 11 through 16.

Figure 12:
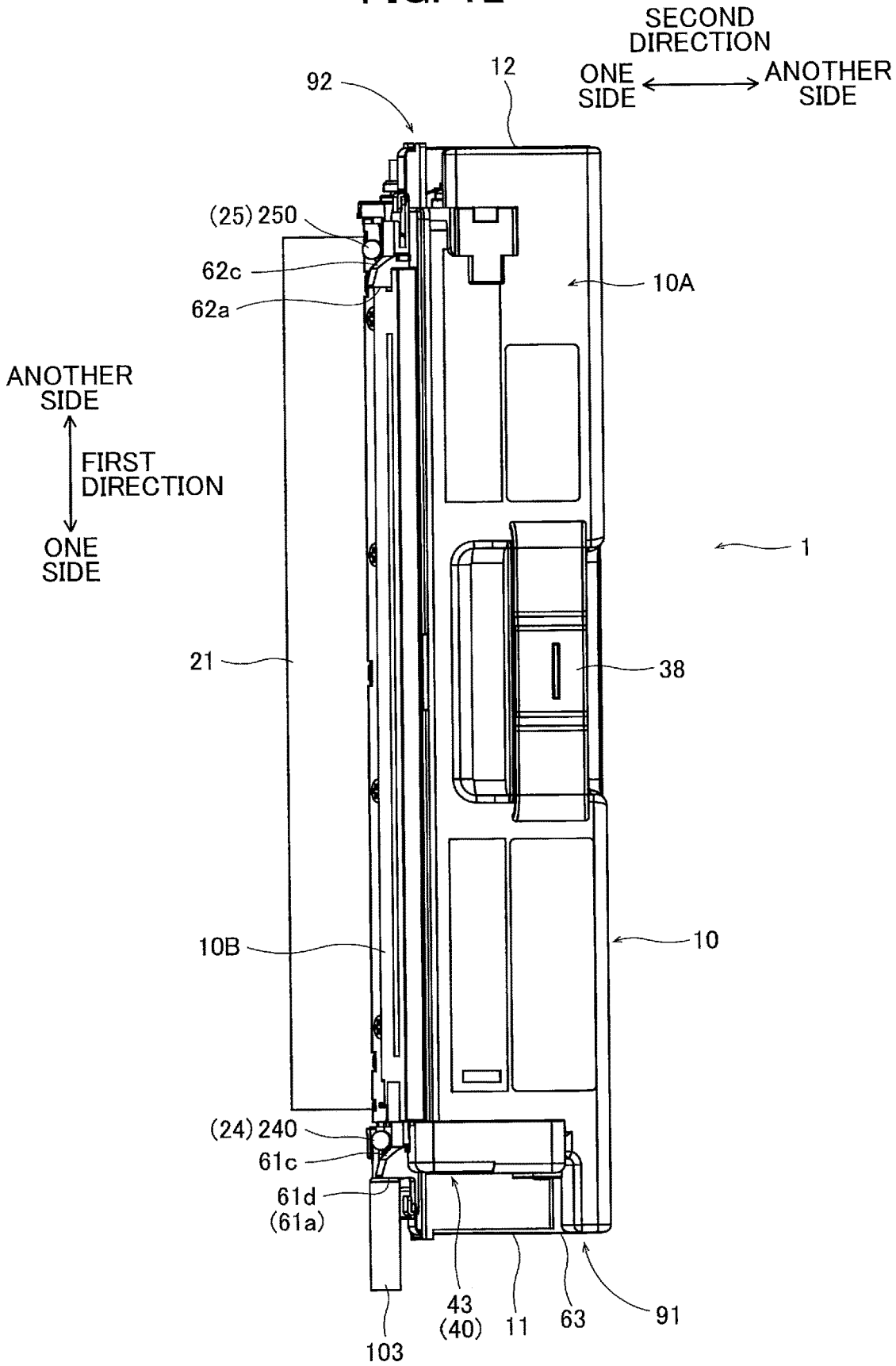
FIG. 12 is a view illustrating the developing cartridge according to the embodiment in the contacting state of the image forming apparatus as viewed in the third direction from the other side toward the one side.
Figure 13:
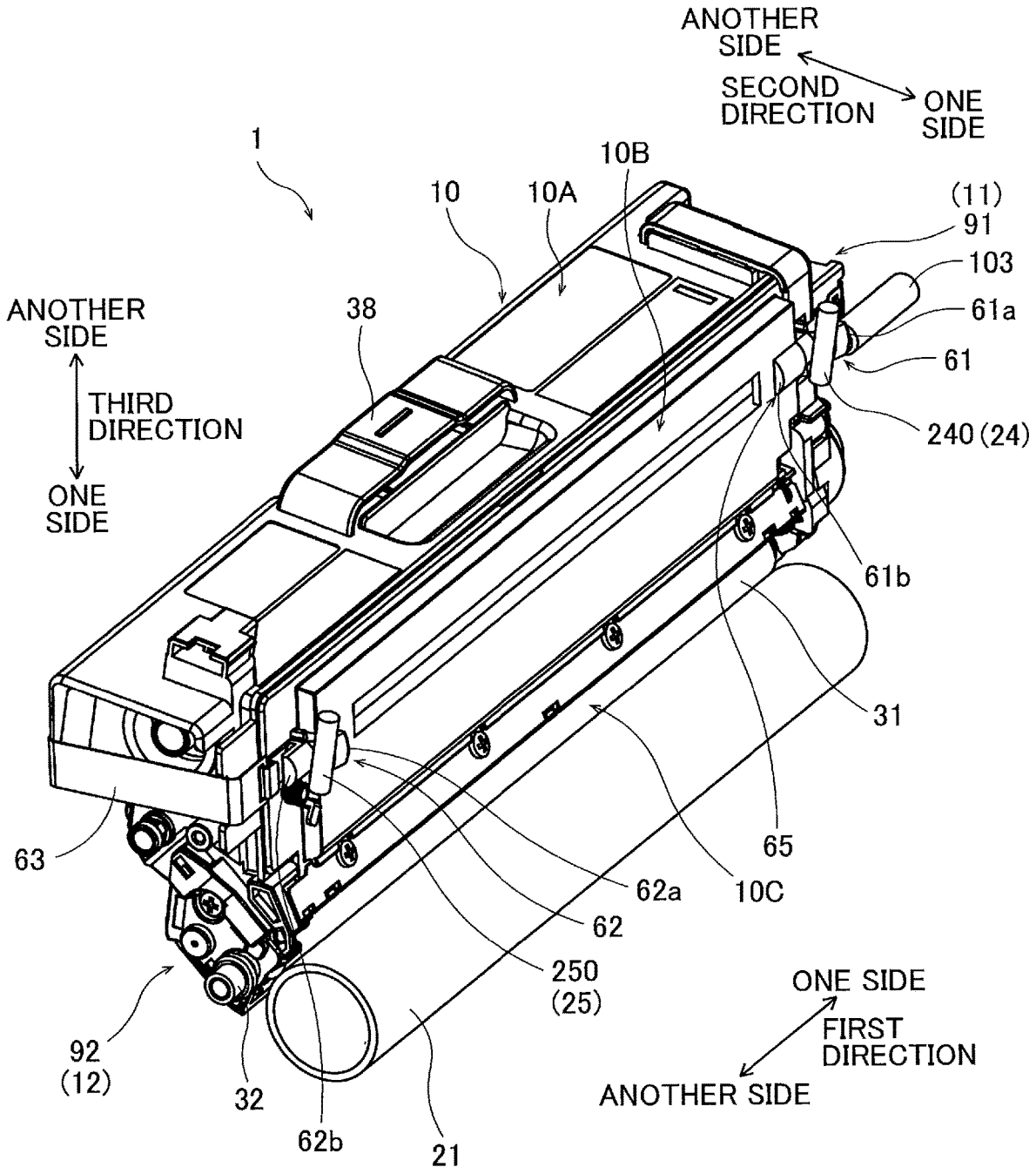
FIG. 13 is a perspective view of the developing cartridge according to the embodiment and the photosensitive drum in the drum cartridge in the contacting state of the image forming apparatus.
Figure 14:
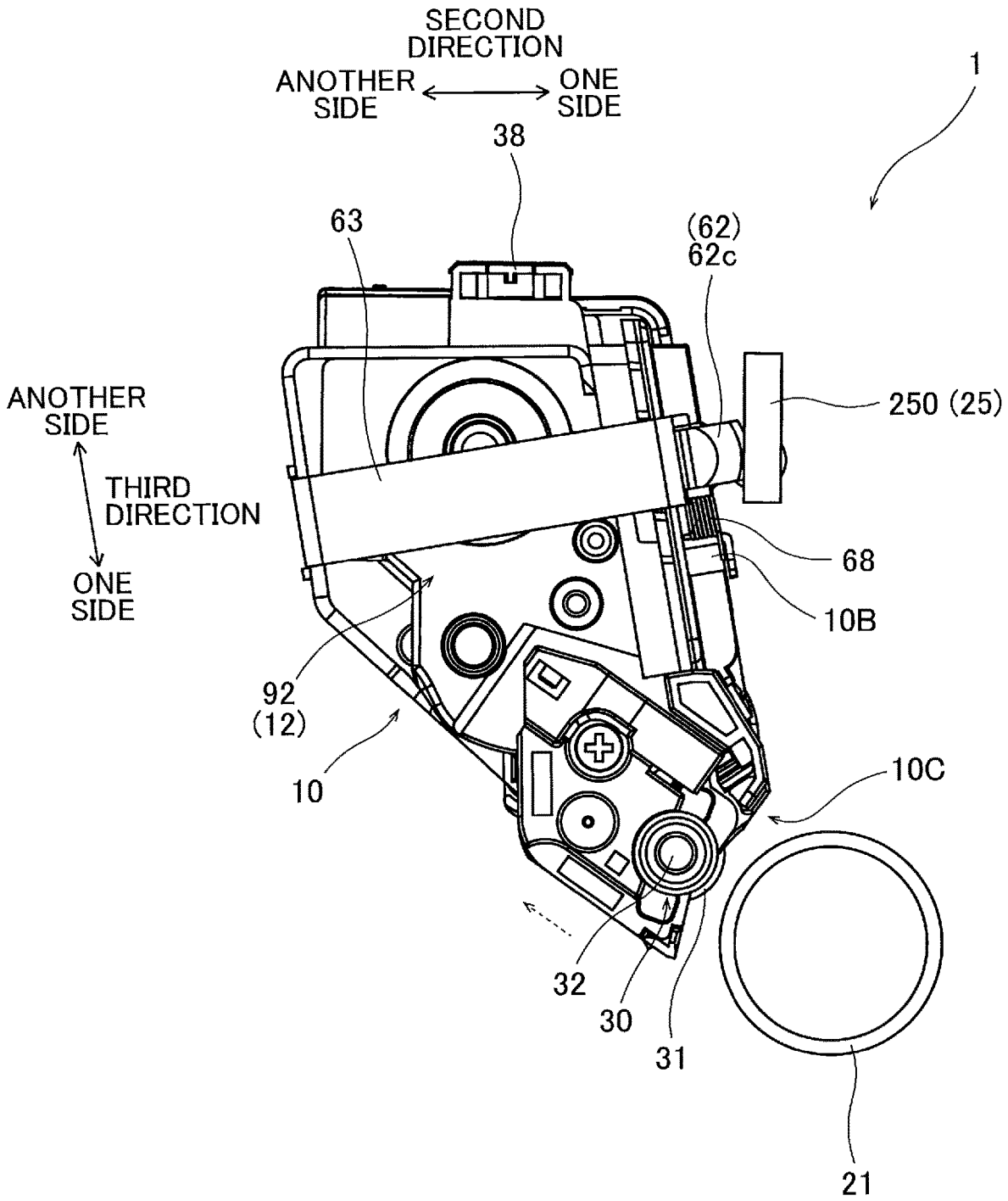
FIG. 14 is a view illustrating the developing cartridge according to the embodiment and the photosensitive drum in the drum cartridge in a separated state of the image forming apparatus as viewed in the first direction from the other side toward the one side.
Figure 15:
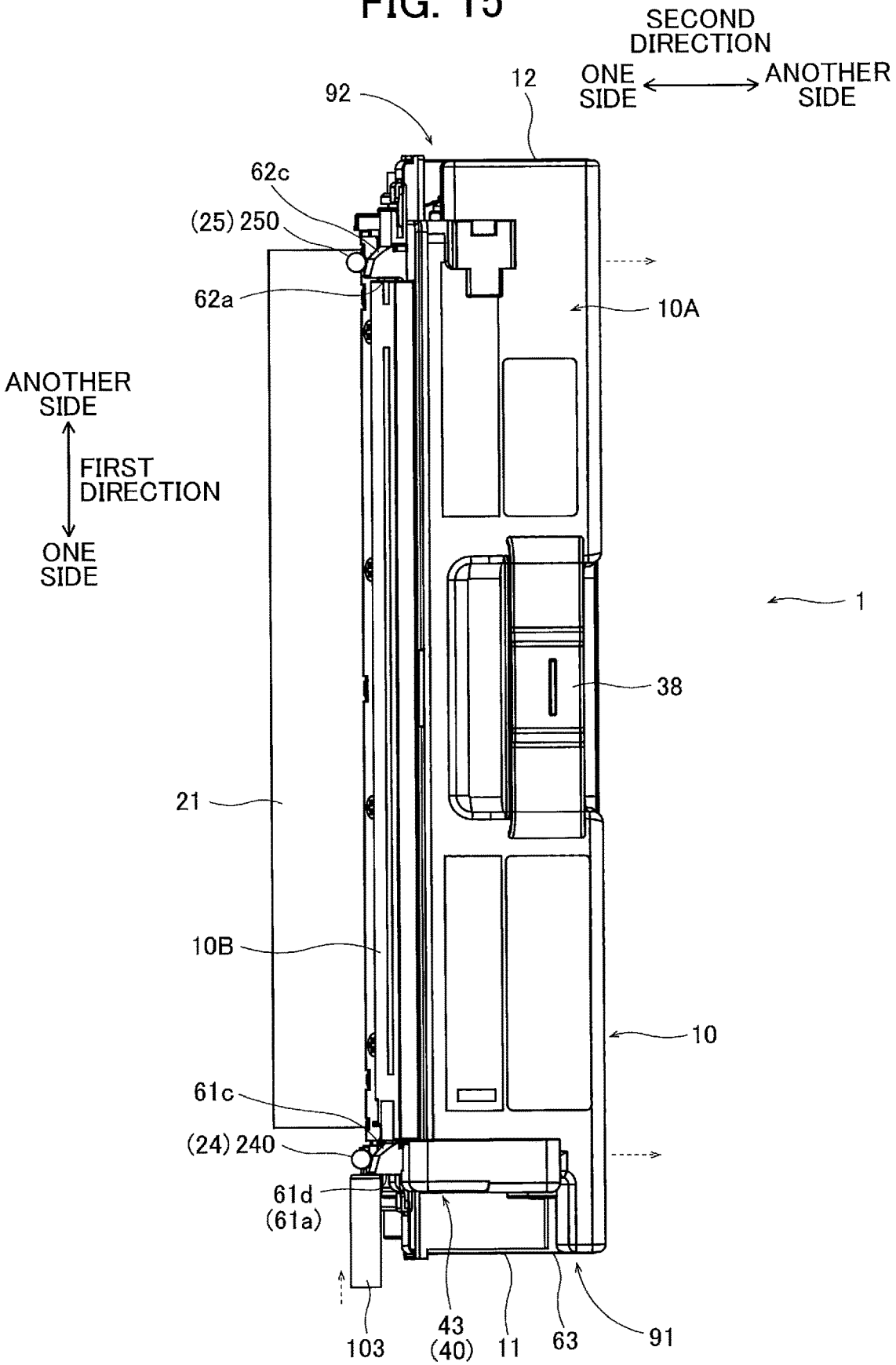
FIG. 15 is a view illustrating the developing cartridge according to the embodiment in the separated state of the image forming apparatus as viewed in the third direction from the other side toward the one side.
Figure 16:
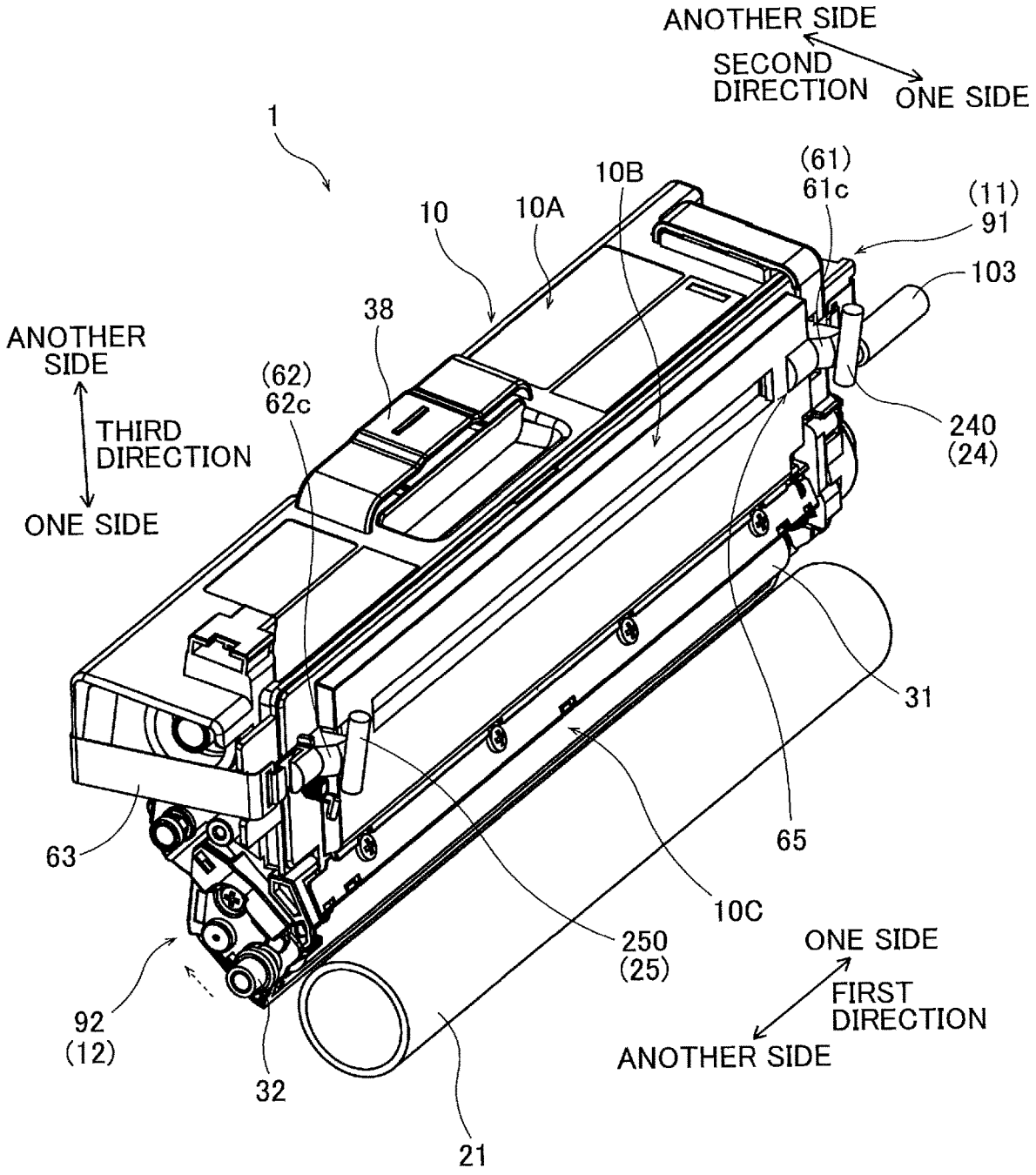
FIG. 16 is a perspective view of the developing cartridge according to the embodiment and the photosensitive drum in the drum cartridge in the separated state of the image forming apparatus.

FIG. 11 is a view of the developing cartridge 1 and the photosensitive drum 21 in the contacting state of the image forming apparatus 100 as viewed in the first direction from the other side toward the one side. FIG. 12 is a view of the developing cartridge 1 in the contacting state of the image forming apparatus 100 as viewed in the third direction from the other side toward the one side. FIG. 13 is a perspective view of the developing cartridge 1 and the photosensitive drum 21 in the contacting state of the image forming apparatus 100. FIG. 14 is a view of the developing cartridge 1 and the photosensitive drum 21 in the separated state of the image forming apparatus 100 as viewed in the first direction from the other side toward the one side. FIG. 15 is a view of the developing cartridge 1 in the separated state of the image forming apparatus 100 as viewed in the third direction from the other side toward the one side. FIG. 16 is a perspective view of the developing cartridge 1 and the photosensitive drum 21 in the separated state of the image forming apparatus 100.

In the image forming apparatus 100, when the drive shaft 103 is driven to move toward the advanced position from the one side toward the other side in the first direction of the casing 10, the pressure contact surface 61*d* of the first cam 61 is pressed by the drive shaft 103. In accordance with application of the pressing force by the drive shaft 103, the first cam 61 moves from the first position to the second position within the first guide groove 65. As the first cam 61 moves to its second position, a tensile force of the connection member 63 becomes greater than a tensile force of the connection member 63 in the first position of the first cam 61. When the tensile force of the connection member 63 becomes greater than the urging force of the elastic member 68, the fourth end 62*b* of the second cam 62 is pulled by the connection member 63, whereby the second cam 62 moves from the third position to the fourth position within the second guide groove 66.

The first inclined surface 61*c* is in contact with the first contact surface 240 of the first cylinder 24. Here, a contacting position of the first inclined surface 61*c* with respect to the first contact surface 240 is gradually shifted from a position close to the second end 61*b* (see FIG. 12) to a position close to the first end 61*a* (see FIG. 15). As a result, a distance in the second direction between the casing 10 and the first contact surface 240 of the first cylinder 24 gradually increases. A pressing force applied to the first inclined surface 61*c* by the first contact surface 240 of the first cylinder 24 causes the casing 10 and the developing roller 30 to move away from the photosensitive drum 21.

Similarly, the second inclined surface 62*c* is in contact with the second contact surface 250 of the second cylinder 25. Here, a contacting position of the second inclined surface 62*c* with respect to the second contact surface 250 is gradually shifted from a position close to the fourth end 62*b* (see FIG. 12) to a position close to the third end 62*a* (see FIG. 15). As a result, a distance in the second direction between the casing 10 and the second contact surface 250 of the second cylinder 25 gradually increases. In this way, the casing 10 and the developing roller 30 move away from the photosensitive drum 21 since the second inclined surface 62*c* is applied with a pressing force by the second contact surface 250 of the second cylinder 25.

As described above, both end portions in the first direction of the casing 10 (i.e., the first inclined surface 61*c* and the second inclined surface 62*c*) are respectively pressed by the first contact surface 240 of the first cylinder 24 and the second contact surface 250 of the second cylinder 25 those are spaced away from each other in the first direction. This configuration can accurately move the casing 10 and the developing roller 30 away from the photosensitive drum 21 while avoiding inclination of the casing 10 relative to the first direction.

On the other hand, when the drive shaft 103 is driven to move toward its retracted position from the other side to the one side in the first direction of the casing 10, the second cam 62 moves back from the fourth position to the third position within the second guide groove 66 because the urging force of the elastic member 68 becomes greater than the tensile force of the connection member 63. Further, the first cam 61 also moves back from the second position to the first position within the first guide groove 65 because the first end 61*a* of the first cam 61 is pulled by the connection member 63. At this time, disengagement of the first cam 61 from the first guide groove 65 can be prevented due to the contact of the retainer 61*e* of the first cam 61 with the inner edge of the notch 43*a*.

In the meantime, the frame 200 of the drum cartridge 2 further includes an urging mechanism (not illustrated) for urging the casing 10 toward the photosensitive drum 21. The urging mechanism urges the developing cartridge 1 in the second direction from the other side toward the one side, whereby the developing roller 30 and the photosensitive drum 21 are again brought into contact with each other. As such, switching between the contacting state (see FIGS. 11 through 13) and the separated state (see FIGS. 14 through 16) can be realized in the image forming apparatus 100.

<6. Summary>

As described above, the developing cartridge 1 according to the present embodiment includes the casing 10, the developing roller 30, the first cam 61, the second cam 62, and the connection member 63. The second cam 62 moves from the third position to the fourth position in accordance with the movement of the first cam 61 from the first position to the second position due to the tensile force of the connection member 63. During the movement, the first cam 61 and the second cam 62 are respectively pressed by the arcuate surfaces (the first and second contact surfaces 240 and 250) of the drum cartridge 2, thereby separating the developing roller 30 from the photosensitive drum 21.

As such, in the developing cartridge 1 according to the present embodiment, the separation of the developing roller 30 from the photosensitive drum 21 can be performed by the driving force applied only to the one side in the first direction of the developing cartridge 1. Application of a driving force to both sides in the first direction of the developing cartridge 1 is unnecessary.

Further, in the developing cartridge 1 according to the present embodiment, the first cam 61 and the second cam 62 are positioned at the third outer surface 13 of the casing 10. In addition, at least a portion of the connection member 63 extends in the first direction along the fourth outer surface 14 of the casing 10. With this configuration, a sufficient length from the one end to the other end of the connection member 63 can be obtained, and at least two bending portions can be provided in the connection member 63. As a result, a tensile force can be generated in the connection member 63 with high accuracy.

Further, in the developing cartridge 1 according to the present embodiment, the first cam 61 has the first inclined surface 61*c*, and the second cam 62 has the second inclined surface 62*c*. With this configuration, the first cam 61 and the second cam 62 can be accurately pressed by the first contact surface 240 and the second contact surface 250 of the drum cartridge 2, respectively, while suppressing inclination of the developing cartridge 1.

Further, the developing cartridge 1 according to the present embodiment includes the elastic member 68. Hence, when a tensile force of the connection member 63 decreases after the second cam 62 is pulled from the third position to the fourth position due to the tensile force of the connection member 63, the second cam 62 can move back from the fourth position to the third position owing to the urging force of the elastic member 68. As a result, the developing roller 30 once moved away from the photosensitive drum 21 can be easily returned to its original position (i.e., the position where the developing roller 30 is in contact with the photosensitive drum 21).

Further, in the developing cartridge 1 according to the present embodiment, the casing 10 has the two positioning grooves 67. At least a portion of the intermediate position of the connection member 63 is positioned within each of the positioning grooves 67. With this configuration, the positioning grooves 67 can restrain at least the portion of the intermediate portion of the connection member 63 from displacing in the third direction.

Further, the casing 10 of the developing cartridge 1 according to the present embodiment includes the lid 10B. The lid 10B has the first guide groove 65 and the second guide groove 66. Since the lid 10B is a flat plate like member, the first guide groove 65 and the second guide groove 66 can be easily formed in the lid 10B.

Further, in the developing cartridge 1 according to the present embodiment, the first cam 61 includes the retainer 61*e*. This retainer 61*e* can restrain disengagement of the first cam 61 from the first guide groove 65 due to the application of tensile force by the connection member 63.

Further, in the developing cartridge 1 according to the present embodiment, the first end 61*a* of the first cam 61 has the pressure contact surface 61*d*. The first cam 61 moves from the first position to the second position when the pressure contact surface 61*d* receives a pressing force. That is, owing to the pressure contact surface 61*d*, the first cam 61 can move from the first position to the second position. Simultaneously, the second cam 62 can move from the third position to the fourth position by the tensile force of the connection member 63 in accordance with movement of the first cam 61 from the first position to the second position.

Further, the main body portion 9 includes the drive shaft 103 in the present embodiment. In the case where the drive shaft 103 applies a pressing force to the pressure contact surface 61*d* of the first cam 61, the first cam 61 moves from the first position to the second position, and the second cam 62 moves from the third position to the fourth position due to the tensile force of the connection member 63. Hence, the developing roller 30 can separate from the photosensitive drum 21 by the driving force received from the main body portion 9.

Further, in the present embodiment, the drum cartridge 2 has the first contact surface 240 and the second contact surface 250. In the state where the developing cartridge 1 is attached to the drum cartridge, the first contact surface 240 is in contact with the first inclined surface 61*c*, and the second contact surface 250 is in contact with the second inclined surface 62*c*. Accordingly, the first cam 61 moves in the first direction from the one side toward the other side while in contact with the first contact surface 240, and the second cam 62 also moves in the first direction from the one side toward the other side while in contact with the second contact surface 250.

With this configuration, the first inclined surface 61*c* is pressed by the first contact surface 240 and the second inclined surface 62*c* is pressed by the second contact surface 250, thereby causing the casing 10 and the developing roller 30 to move from a contacting state where the developing roller 30 is in contact with the photosensitive drum 21 to a separated state where the developing roller 30 is separated from the photosensitive drum 21. Also, this configuration can restrain the casing 10 and the developing roller 30 from being inclined relative to the first direction.

Further, the first cylinder 24 is rotatable about the first rotational axis, and the second cylinder 25 is rotatable about the second rotational axis in the present embodiment. Accordingly, a frictional force generated between the first inclined surface 61*c* and the first contact surface 240, and a frictional force generated between the second inclined surface 62*c* and the second contact surface 250 can be reduced in the case where the first cam 61 and the second cam 62 move in the first direction toward from the one side toward the other side in a state where the first contact surface 240 is in contact with the first inclined surface 61*c* and the second contact surface 250 is in contact with the second inclined surface 62*c*.

<7. Modifications>

While the description has been made in detail with reference to the specific embodiment, it would be apparent to those skilled in the art that various modifications can be made thereto.

In the above-described embodiment, at least a portion of the connection member 63 extends in the first direction on the fourth outer surface 14 of the casing 10. Instead of the above configuration, at least a portion of the connection member 63 may extend in the first direction on the outer surface of the casing 10 where the handle 38 is positioned. That is, it is preferable that the connection member 63 has a portion that extends in the first direction on an outer surface of the casing 10 different from the third outer surface 13.

While only the first cam 61 has the retainer 61*e* in the above-described embodiment, not only the first cam 61 but also the second cam 62 may have a retainer.

In the above-described embodiment, the connection member 63 is a sheet-like member. However, the connection member 63 may be a wire member. Further, the connection member 63 is formed of resin in the above-described embodiment. However, instead of resin, the connection member 63 may be formed of metal (such as leaf spring).

In the above-described embodiment, two of the positioning grooves 67 are spaced away from each other in the first direction on the fourth outer surface 14 of the casing 10. However, one positioning groove 67 may be positioned to extend over an entire region of the casing 10 from the one end portion 91 to the other end portion 92 in the first direction.

Further, the detailed configuration and the shape of the developing cartridge may be suitably modified without departing from the scope of the present disclosure. Further, each component in the above-described embodiment and the above modifications may be suitably combined together avoiding conflicting combination.

What is claimed is:

1. A developing cartridge comprising:

a casing configured to accommodate developing agent therein, the casing including one end portion and another end portion spaced apart from the one end portion in a first direction;

a developing roller rotatable about a developing roller axis extending in the first direction;

a first cam positioned at the one end portion of the casing, the first cam being movable relative to the casing and the developing roller in the first direction between a first position and a second position, the first cam in the second position being positioned closer to the another end portion of the casing in the first direction than the first cam in the first position is to the another end portion of the casing;

a second cam positioned at the another end portion of the casing, the second cam being movable relative to the casing and the developing roller in the first direction between a third position and a fourth position, the second cam in the fourth position being positioned closer to the another end portion of the casing in the first direction than the second cam in the third position is to the another end portion of the casing; and a connection member connecting the first cam and the second cam to each other, wherein the second cam is movable from the third position to the fourth position due to a tensile force of the connection member in accordance with movement of the first cam from the first position to the second position.

2. The developing cartridge according to claim 1, wherein the first cam has a first end and a second end, the second end being positioned closer to the another end portion of the casing in the first direction than the first end is to the another end portion of the casing, wherein the second cam has a third end and a fourth end, the fourth end being positioned closer to the another end portion of the casing in the first direction than the third end is to the another end portion of the casing, and wherein the connection member connects the first end of the first cam and the fourth end of the second cam to each other.

3. The developing cartridge according to claim 2, wherein the first end of the first cam has a pressure contact surface for receiving a pressing force, and wherein, when the pressure contact surface receives the pressing force, the first cam moves from the first position to the second position.

4. The developing cartridge according to claim 3, wherein the developing cartridge is for use with a drum cartridge, the drum cartridge being attachable to a main body portion of an image forming apparatus in a state where the developing cartridge is attached to the drum cartridge, the main body portion including a drive shaft extending in the first direction, the drive shaft being movable in the first direction between an advanced position and a retracted position in response to receiving a driving force applied from the main body portion, the drive shaft being configured to press the pressure contact surface by the movement of the drive shaft toward the advanced position which is a direction from the one end portion to the another end portion of the casing in the first direction.

5. The developing cartridge according to claim 1, wherein the developing roller has an outer circumferential surface including one end portion and another end portion in a second direction crossing the first direction, the one end portion in the second direction of the outer circumferential surface of the developing roller being exposed to an outside of the casing, the another end portion in the second direction of the outer circumferential surface of the developing roller being positioned inside the casing.

6. The developing cartridge according to claim 5, wherein the casing has one outer surface and another outer surface, the one outer surface being positioned at one end portion in the second direction of the casing, the another outer surface being positioned at another end portion in the second direction of the casing, wherein the first cam and the second cam are positioned at the one outer surface, and wherein the connection member has at least a portion extending in the first direction along the another outer surface.

7. The developing cartridge according to claim 6, wherein the casing further has a groove positioned at the another outer surface and extending in the first direction, and wherein the connection member has at least a portion positioned within the groove.

8. The developing cartridge according to claim 6, wherein the casing has a first guide groove and a second guide groove positioned at the one outer surface, the first guide groove guiding movement of the first cam between the first position and the second position, the second guide groove guiding movement of the second cam between the third position and the fourth position.

9. The developing cartridge according to claim 8, wherein the casing includes a frame having a flat plate shape and positioned at the one outer surface, the frame having the first guide groove and the second guide groove.

10. The developing cartridge according to claim 8, wherein at least one of the first cam and the second cam includes a retainer for preventing the at least one of the first cam and the second cam from disengaging from corresponding one of the first guide groove and the second guide groove.

11. The developing cartridge according to claim 5, wherein the casing has one outer surface and another outer surface, the one outer surface being positioned at one end portion in the second direction of the casing, the another outer surface being different from the one outer surface, wherein the first cam and the second cam are positioned at the one outer surface, and wherein the connection member has at least a portion extending in the first direction along the another outer surface.

12. The developing cartridge according to claim 5, wherein the first cam has a first inclined surface inclined relative to the first direction so as to be distant from the casing as extending from the another end portion to the one end portion of the casing, and wherein the second cam has a second inclined surface inclined relative to the first direction so as to be distant from the casing as extending from the another end portion to the one end portion of the casing.

13. The developing cartridge according to claim 12, wherein the first inclined surface gradually approaches the casing in the second direction as extending from the one end portion to the another end portion in the first direction of the casing, and wherein the second inclined surface gradually approaches the casing in the second direction as extending from the one end portion to the another end portion in the first direction of the casing.

14. The developing cartridge according to claim 12, wherein the developing cartridge is for use with a drum cartridge, the drum cartridge has having a first contact surface and a second contact surface, the drum cartridge being attachable to a main body portion of an image forming apparatus in a state where the developing cartridge is attached to the drum cartridge, and wherein, in the state where the developing cartridge is attached to the drum cartridge, the first contact surface is in contact with the first inclined surface, and the second contact surface is in contact with the second inclined surface.

15. The developing cartridge according to claim 14, wherein the first contact surface is at least a portion of an outer circumferential surface of a first cylinder centered on a first rotational axis extending in a third direction crossing the first direction, and wherein the second contact surface is a at least a portion of an outer circumferential surface of a second cylinder centered on a second rotational axis extending in the third direction.

16. The developing cartridge according to claim 15, wherein the first cylinder is rotatable about the first rotational axis, and wherein the second cylinder is rotatable about the second rotational axis.

17. The developing cartridge according to claim 5, wherein the first cam is movable in the second direction together with the casing and the developing roller, and wherein the second cam is movable in the second direction together with the casing and the developing roller.

18. The developing cartridge according to claim 5, wherein the developing cartridge is for use with a drum cartridge including a photosensitive drum, and wherein, in a state where the developing cartridge is attached to the drum cartridge, the first cam is movable in the second direction relative to the photosensitive drum together with the casing and the developing roller, and the second cam is movable in the second direction relative to the photosensitive drum together with the casing and the developing roller.

19. The developing cartridge according to claim 18, wherein, in the state where the developing cartridge is attached to the drum cartridge, the developing roller is in contact with the photosensitive drum in the first position of the first cam and in the third position of the second cam, and the developing roller is separated from the photosensitive drum in the second position of the first cam and at the fourth position of the second cam.

20. The developing cartridge according to claim 5, wherein the casing has one end portion in a third direction crossing the first direction and the second direction, and wherein the developing roller is positioned at the one end portion in the third direction of the casing.

21. The developing cartridge according to claim 20, wherein the casing further has an outer surface positioned at another end portion in the third direction of the casing, the developing cartridge further comprising a handle configured to be gripped by a user, the handle being positioned at the outer surface.

22. The developing cartridge according to claim 1, wherein the connection member is a flexible member.

23. The developing cartridge according to claim 22, wherein the connection member is one of a sheet-like member and a wire member.

24. The developing cartridge according to claim 1, wherein the connection member has a portion extending in the first direction and another portion extending in a direction crossing the first direction.

25. The developing cartridge according to claim 1, further comprising an elastic member urging the second cam in a direction from the fourth position toward the third position.

26. The developing cartridge according to claim 25, wherein the elastic member is a spring.

27. The developing cartridge according to claim 26, wherein the spring is a coil spring.

28. The developing cartridge according to claim 1, wherein the connection member is made from resin.

* * * * *